United States Patent [19]

Frankenfeld et al.

[11] Patent Number: 4,532,027

[45] Date of Patent: Jul. 30, 1985

[54] METHOD FOR IMPROVING THE STABILITY OF SHALE OIL

[75] Inventors: John W. Frankenfeld, Atlantic Highlands; Robert L. Bruncati, Hazlet, both of N.J.

[73] Assignee: Exxon Research and Engineering Co., Florham Park, N.J.

[21] Appl. No.: 567,565

[22] Filed: Jan. 3, 1984

[51] Int. Cl.[3] ..... C10G 19/02; C10G 31/06

[52] U.S. Cl. ..... 208/255; 208/258; 208/259; 208/230

[58] Field of Search ..... 208/258, 259, 230, 255

[56] References Cited

U.S. PATENT DOCUMENTS

| | | | |
|---|---|---|---|
| 1,592,329 | 7/1926 | Black et al. | 208/259 |
| 2,165,732 | 7/1939 | Sontag | 208/230 |
| 2,315,662 | 4/1943 | Schulze et al. | 208/230 |
| 2,385,175 | 9/1945 | Wachter et al. | 208/230 |
| 2,725,339 | 11/1955 | Browning, Jr. et al. | 208/230 |
| 2,953,522 | 9/1960 | Wolfson | 208/259 |
| 3,011,970 | 12/1961 | Goodmann et al. | 208/230 |

OTHER PUBLICATIONS

Yabroff, "Extraction of Mercaptans with Alkaline Solution", Industrial and Engineering Chemistry, vol. 32, No. 2, pp. 257-262.

*Primary Examiner*—D. E. Gantz
*Assistant Examiner*—Chung K. Pak
*Attorney, Agent, or Firm*—Eugene Zagarella; Edward H. Mazer

[57] ABSTRACT

A method for improving the storage stability of shale oil liquids by extracting or contacting the shale oil with a base solution having a pH of at least about 7.5 to inhibit the formation or reduce the level of sediment and gum which can form in said shale oil.

5 Claims, 1 Drawing Figure

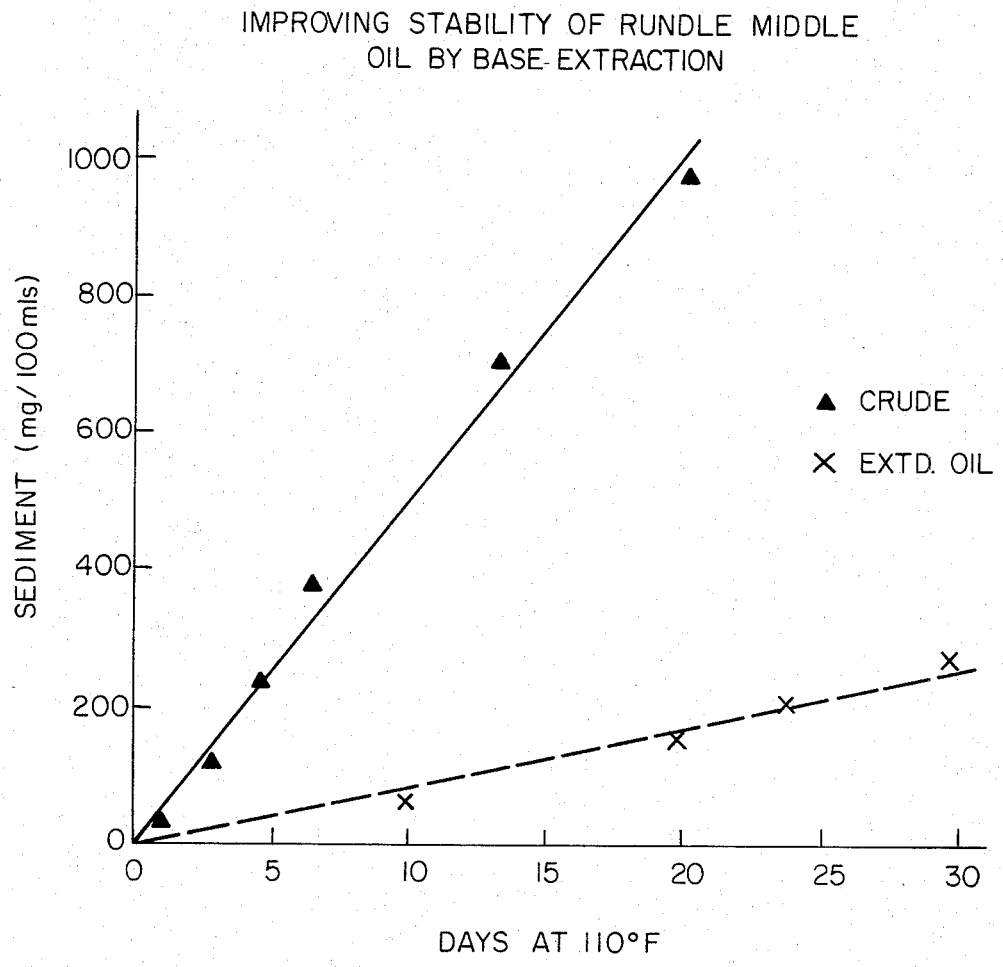
IMPROVING STABILITY OF RUNDLE MIDDLE OIL BY BASE-EXTRACTION
SEDIMENT (mg/100mls)
1000
800
600
400
200
0
0
5
10
15
20
25
30
DAYS AT 110°F
CRUDE
EXTD. OIL

METHOD FOR IMPROVING THE STABILITY OF SHALE OIL

FIELD OF THE INVENTION

The present invention relates to a method for enhancing the stability of shale oil by extracting the shale oil with a basic solution to inhibit the formation or reduce the level of sediment and gum which forms in said shale oil.

BACKGROUND OF THE INVENTION

The dwindling supplies of known petroleum and natural gas reserves have led to a search for alternate energy sources. Oil shale, because of its great abundance, is considered one of the primary sources of liquid fuels to supplement and replace those now obtained from petroleum.

Generally, shale oil is produced or recovered from oil shale by pyrolysis. A number of different processes are known for recovering shale oil from the oil shale or sedimentary rock. While the liquid products derived from oil shale by these techniques represent products of somewhat differing but suitable quality, they generally require further upgrading and processing before they can be employed as feedstocks in conventional refining operations. One of the problems involved in working with such liquids is the presence of finely divided solids, particulate and dust. These solids or fines have been typically removed from shale oil by a process called dedusting. In this process solids are removed from shale oil by addition of water to the shale oil and then subjecting the mixture to an electrostatic field to resolve it into a dedusted shale oil phase and an aqueous phase which carries the finely-divided solids.

Another problem associated with the liquid fuels derived from oil shale is their poor stability characteristics. Instability in such fuels is generally manifested by the formation of large quantities of sediment or gum during storage. It has been known to stabilize shale liquids by hydrotreating. This technique which involves either the removal of unstable species or converting them to stable compounds, while generally suitable, requires an additional process step which can be expensive.

SUMMARY OF THE INVENTION

In accordance with the present invention, there is provided a method for the stabilization of shale oil liquids by inhibiting the formation or reducing the level of sediment and gum formed in said liquid composition by extracting said shale liquid with an effective stabilizing amount of a basic solution having a pH of at least about 7.5.

In a preferred embodiment of the present invention, the shale oil is extracted or contacted with the basic shale retorting process water.

BRIEF DESCRIPTION OF THE DRAWINGS

The instant invention may be better understood by reference to the accompanying drawing wherein the FIGURE graphically illustrates the amount of sediment formation vs. time for a treated and untreated oil.

DETAILED DESCRIPTION OF THE INVENTION

This invention relates to a method for improving the storage stability of shale oil liquids by extracting or contacting the shale oil with a basic solution to inhibit the formation or reduce the level of sediment and gum which can form in said shale oil.

Shale oil as used in this invention is any crude dark oil obtained from oil shale by heating or pyrolysis. Particularly preferred shale oils are those produced from oil shale retorting processes which involve the crushing and heating of large quantities of raw oil shale and the cooling and discharging of equally large quantities of spent shale and the collection of shale oil which can be upgraded and separated into different retort products.

In carrying out the method of this invention, any weak to moderately strong basic or base solution can be used with the pH generally being at least about 7.5. More particularly, the basic solution will be an aqueous solution of an alkali metal or alkaline earth metal hydroxide, an aqueous solution of ammonia (ammonium hydroxide) or the shale oil process or retort process water, sometimes called "sour water", which is moderately basic (8 to 9.0 pH) and is readily available at the retort processing site. Preferred base solutions are sodium hydroxide (caustic), potassium and calcium hydroxide (lime), aqueous solutions of ammonia and shale retorting process water with shale retorting process water being particularly preferred. The selected base solution will preferably have a pH of at least about 8.0 and more preferably will have a pH of at least about 8.5.

The amount of base solution used in this invention can be varied depending on the particular solution use, the pH and the nature of the treatment. Using too low an amount of base solution may tend to result in emulsion formation while use of too high an amount could become expensive. Generally, from about 1:20 to about 20:1 parts by volume of base solution per part by volume of treated shale oil will be used and preferably from about 1:5 to about 5:1 parts by volume of base solution.

In carrying out the method of this invention generally any of the various known means for carrying out extraction operations may be used as disclosed for example in Kirk-Othmer, "Encyclopedia of Chemical Technology," Second Edition, Vol. 8, 1965, pp. 719–775. Generally, the method may be carried on in countercurrent or cocurrent operations, for periods of 0.5 minute or even less up to several days. Typically, the extraction method will be carried on for a time period of from about 0.5–1 minute up to about 10 minutes. The temperature of the method is not particularly critical, although some shale oil may require temperatures elevated from ambient to get proper fluid conditions. Generally, the temperature will range from about 20° to about 75° C., with about 30° to about 50° C. being preferred.

The following examples will serve to more fully illustrate and describe the manner of practicing the above-described invention. It is to be understood that these examples in no way serve to limit the scope of this invention, but rather, are presented for illustrative purposes.

EXAMPLE I

A quantity of middle oil (1000 cc) from Rundle (Australian) shale having a boiling range of about 300° to 950° F. was extracted with 2000 cc of 1N NaOH by gentle shaking in a separating funnel. The layers were separated and the extracted oil was washed successively with water, 0.1N aqueous HCl, and water. The oil was then divided into 200 cc portions and stored at 110° F. Portions were removed at various time periods and the amount of sediment formed was determined gravimetrically. Untreated Rundle middle oil was tested in similar fashion to serve as a control. The results are given in Table 1. A plot of sediment formation vs. time for treated and untreated oil is shown in the FIGURE.

A similar experiment was conducted with Rundle Light Oil and other Rundle Middle Oils and results are also given in Table 1.

TABLE 1

STABILIZING SHALE OILS BY BASE EXTRACTION

| | Treatment | Sediment (mg/100 cc) at 110° F. After 3 days | 7 days | 10 days | 14 days | 21 days |
|---|---|---|---|---|---|---|
| Rundle Middle Oil A(1) | none (controls) | — | — | 480 | — | 986 |
| Rundle Middle Oil A | base extracted | — | — | 52.0 | — | 168 |
| Rundle Middle Oil B(1) | none | — | 156 | — | 592 | — |
| | base extracted | — | 47.1 | — | 59.2 | — |
| Rundle Light Oil(2) | none | 123 | — | — | — | — |
| | base extracted | 47.5 | — | — | — | — |
| Rundle Middle Oil C(3) | none | — | 44.6 | — | 135 | — |
| | base extracted | — | 8.5 | — | 31.9 | — |

(1)Boiling range of 300 to 950° F.
(2)Boiling range of 150 to 700° F.
(3)Boiling range of 650 to 950° F.

The results of these experiments illustrate the advantages which accrue from base treatment of crude shale liquids. Reduction in sediment levels ranged from 60% for Rundle light oil to nearly 90% for Rundle middle oil for storage periods up to 21 days.

EXAMPLE II

Several hundred cc's of "Colony light oil" derived from Colony oil shale by a retorting process and having a boiling range of 150° to 700° F. were allowed to stand in contact with 50 cc of retort process waste water for several weeks at 40° F. The layers were separated and the treated oil subjected to the accelerated storage stability test as described in Example I. Untreated oil was tested at the same time to serve as a control with results given in Table 2. Sediment levels were reduced by over 70% after 21 days by means of this treatment.

TABLE 2

STABILIZING COLONY LIGHT OIL

| Treament | Sediment (mg/100 cc) After 7 Days | 14 Days | 21 Days |
|---|---|---|---|
| None | 12.5 | 20.0 | 65.0 |
| Contacting with process water | 7.4 | 12.8 | 14.2 |

EXAMPLE III

A 500 cc quantity of Rundle middle distillate oil having a boiling range of 300° to 950° F. was extracted three times with 100 cc of retort process water having a pH of 8.6 ("sour water"). After separating the layers, the oil phase was washed twice with water and then stored at 110° F. for 7, 14, and 21 day periods. The sediment produced was measured gravimetrically and compared with the amounts produced in untreated oil. Results are summarized in Table 3, with improvements in stability of nearly 90% achieved.

The process water recovered from the test above was re-used to extract a sample of Rundle stabilizer light oil (SLO) having a boiling range of 150° to 600° F. The experiment was carried out as above for a storage period of 21 days. The results given in Table 3 show that the re-use of "sour water", while not as effective as fresh "sour water", still provides some degree of stabilization.

TABLE 3

STABILIZING RAW SHALE OILS BY TREATMENT WITH RETORT PROCESS WATER

| Oil | Treatment | Sediment (mg/100 mls) After(3) 7 Days | 14 Days | 21 Days |
|---|---|---|---|---|
| Rundle Middle Oil(1) | None | 400 | 680 | 980 |
| Rundle Middle Oil(1) | "Sour Water" | 46.6 | 105 | 150 |
| Rundle Light Oil(2) | None | — | — | 650 |
| Rundle Light Oil(2) | "Sour Water"(4) | — | — | 240 |

(1)Boiling range 300 to 950° F.
(2)Boiling range 150 to 600° F.
(3)Average of two replicates.
(4)Re-used.

EXAMPLE IV

In order to further show the scope of this invention, a variety of shale oils were extracted with different bases and then tested for storage stability as described in Examples I to III. A summary of the results is shown in Table 4.

TABLE 4

SUMMARY OF BASE EXTRACTION EXPERIMENTS WITH VARIOUS RAW RUNDLE SHALE OILS

| Oil | Treatment | Time | Storage Test Results(1) % Improvement(10) |
|---|---|---|---|
| Rundle Middle Oil A(2) | NaOH | 7-21 Days | 82-90 |
| Rundle Middle Oil B(3) | NaOH | 14 Days | 80 |
| | "Sour Water" | 7-21 Days | 75-90 |
| Rundle Light Oil(4) | NaOH | 14 Days | 40 |
| Rundle Whole Oil(5) | NaOH | 7-14 Days | 40-50 |
| Rundle Whole Oil B(6) | NaOH | 7-14 Days | 85 |
| | "Sour Water" | | 50-75 |
| Rundle Middle Oil C(7) | "Sour Water" | 7-21 Days | 40-70 |
| Rundle Light Oil B(8) | "Sour Water"(9) | 14 Days | 63 |

(1)Stored at 110° F.; 7 days at this temp. is equivalent to one month ambient; results are average of 2-4 replictes.
(2)Boiling Range 300-950° F.
(3)Boiling Range 300-950° F.
(4)Boiling Range 150-700° F.
(5)Boiling Range 100-1050° F.
(6)Boiling Range 150-1000° F.
(7)Boiling Range 170-700° F.
(8)Boiling Range 150-600° F.
(9)Re-used.
(10)% improvement is $$\frac{(\text{Sediment Raw Oil}) - (\text{Sediment Extracted Oil})}{(\text{Sediment Raw Oil})} \times 100$$

What is claimed is:

1. A method for improving the storage stability of shale oil liquid comprising extracting the shale oil liquid with an effective stabilizing amount of a base solution comprising shale oil retort process water having a pH of at least about 7.5 to inhibit the formation or reduce the level of sediment or gum formed.

2. The method of claim 1 wherein from about 1:20 to about 20:1 parts by volume of base solution per part by volume of shale oil are used.

3. The method of claim 2 wherein said base solution has a pH of at least about 8.0

4. The method of claim 3 wherein from about 1:5 to about 5:1 parts by volume of base solution per part by volume of shale oil are used.

5. The method of claim 4 wherein said base solution has a pH of at least about 8.5.

* * * * *